US011425978B2

(12) United States Patent
Chen et al.

(10) Patent No.: US 11,425,978 B2
(45) Date of Patent: Aug. 30, 2022

(54) ROLL TOP BACKPACK WITH SPEAKER DEVICE

(71) Applicant: ZTARX CORPORATION LIMITED, Shenzhen (CN)

(72) Inventors: Song Ping Chen, Shenzhen (CN); Benjamin Goh Swee Hock, Shenzhen (CN)

(73) Assignee: ZTARX CORPORATION LIMITED, Shenzhen (CN)

( * ) Notice: Subject to any disclaimer, the term of this patent is extended or adjusted under 35 U.S.C. 154(b) by 268 days.

(21) Appl. No.: 16/435,581

(22) Filed: Jun. 10, 2019

(65) Prior Publication Data

US 2020/0383444 A1 Dec. 10, 2020

(51) Int. Cl.

| | |
|---|---|
| ***A45C 15/00*** | (2006.01) |
| ***A45C 3/10*** | (2006.01) |
| ***A45F 3/04*** | (2006.01) |
| ***H04R 1/44*** | (2006.01) |
| ***H04R 5/02*** | (2006.01) |
| ***A45C 11/22*** | (2006.01) |

(52) U.S. Cl.

CPC ..... *A45C 15/00* (2013.01); *A45C 3/10* (2013.01); *A45C 11/22* (2013.01); *A45F 3/04* (2013.01); *H04R 1/44* (2013.01); *H04R 5/02* (2013.01); *H04R 2201/023* (2013.01)

(58) Field of Classification Search

CPC . A45C 15/00; H04R 1/44; H04R 5/02; H04R 2201/023

See application file for complete search history.

(56) References Cited

U.S. PATENT DOCUMENTS

| | | | | |
|---|---|---|---|---|
| 9,080,736 | B1 | 7/2015 | Salzinger | |
| 9,271,061 | B1 * | 2/2016 | Amores | H04R 1/028 |
| 10,034,072 | B2 | 7/2018 | Chen | |
| 10,612,738 | B1 | 4/2020 | Sreshta | |
| 2006/0182297 | A1 * | 8/2006 | Cyr | A41D 1/005 381/301 |

(Continued)

OTHER PUBLICATIONS

Soul Gear User Guide: https://cdn.shopify.com/s/files/1/2411/8385/files/SOUL_GEARL_User_Guide.pdf?883 (Year: 2019).*

(Continued)

*Primary Examiner* — John K Fristoe, Jr.
*Assistant Examiner* — Justin Caudill

(57) ABSTRACT

A roll top backpack with a waterproof speaker device comprises a speaker device and a roll top backpack, wherein the roll top backpack is provided with a speaker device placement hole, the speaker device is arranged in the speaker device placement hole, and the speaker device is sealed with the speaker device placement hole; due to the fact that the roll top backpack is made of waterproof materials and the speaker device is sealed with the speaker device placement hole, the inner part and the outer part can be waterproof when the whole roll top backpack is rolled up, moisture cannot permeate into the roll top backpack through the speaker device, and cannot permeate out through the speaker device from inside of the backpack, so that the roll top backpack can be used in various environments of outdoor hiking, camping or water sports.

7 Claims, 6 Drawing Sheets

(56) References Cited

U.S. PATENT DOCUMENTS

| | | | | |
|---|---|---|---|---|
| 2009/0311928 | A1* | 12/2009 | McClintock | B63C 9/20 441/89 |
| 2014/0369542 | A1* | 12/2014 | Lee | H04R 1/44 381/334 |
| 2016/0212526 | A1* | 7/2016 | Salvatti | H04R 1/026 |
| 2016/0270454 | A1* | 9/2016 | Gehlen | A41D 13/0015 |
| 2017/0181303 | A1* | 6/2017 | Li | B29C 45/1671 |
| 2017/0234493 | A1 | 8/2017 | Stork | |
| 2018/0278053 | A1* | 9/2018 | Uan-Zo-Ii | H02J 1/00 |

OTHER PUBLICATIONS

Voltaic: https://blog.voltaicsystems.com/usb-c-power-delivery/#comments (Year: 2018).*

Digi-Key: https://www.digikey.com/en/articles/designing-in-usb-type-c-and-using-power-delivery-for-rapid-charging (Year: 2017).*

Amazon.com : https://www.amazon.com/dp/B07SMQD6R7?psc=1&spLa=ZW5jcnlwdGVkUXVhbGlmaWVyPUEyQzNBRjFPN1ExNjhIJmVuY3J5cHRIZEIkPUEwMzk5MjMyMlowSTVPSUU3MFA5MiZlbmNyeXB0ZWRBZEIkPUEwOTA1ODlwQ1NLNkdZU09DWDUwJndpZGdldE5hbWU9c3BfdnNIX1JWUF9kZXRhaWwmYWN0aW9uPWNsaWNrUmVkaXJIY3QmZG9Ob3RMb2dDbGljaz10cnVI (Year: 2019).*

Solar Sporting Goods, SOUL GEAR Waterproof Dry Bag Solar USB Wireless Bluetooth Speaker, May 14, 2019, Solar Sporting Goods, https://www.solarsportinggoods.com/products/soul-gear-waterproof-dry-bag-with-solar-wireless-bluetooth-speaker.

Solar Sporting Goods, SOUL GEAR Waterproof Dry Bag & Wireless Bluetooth Speaker, May 18, 2019, YouTube, https://www.youtube.com/watch?v=TEPK_qkfylk.

Michael J. Troughton, Handbook of Plastics Joining: A Practical Guide (Plastics Design Library) 2nd Edition, C2008 Chapters 1, 5, and 12. William Andrew, Norwich, NY.

* cited by examiner

1

ROLL TOP BACKPACK WITH SPEAKER DEVICE

TECHNICAL FIELD

The invention relates to the field of backpack articles of daily use, in particular to a roll top backpack with a speaker device. The roll top backpack with the speaker device is a multifunctional integrated waterproof bag which is portable and foldable, convenient to storage, capable of lighting in emergency, playing music and charging electronic equipment in emergency.

BACKGROUND ART

Along with the improvement of the living standard, more and more people pursue freely enjoyed outdoor life after busy work. In the outdoor activities, we naturally need to carry a plurality of private articles, so that better and more convenient storage tools become necessary articles for the outdoor activities, and real outdoor activities often need more things: for example, water-proof backpacks, water-proof LED lamps, water-proof sound boxes, chargers and the like, so as to meet the necessary requirements of outdoor life of people. However, the existing backpacks or water-proof bags on the market can only meet the single water-proof function and storage function and cannot meet the multiple requirements of consumers, so that a design of a multifunctional integrated bag convenient to storage and having the functions of waterproofness, lighting, sound boxes and charging electronic equipment in emergency becomes a product rigidly demanded by the current consumer market.

SUMMARY OF THE UTILITY MODEL

In order to solve the problems, the utility model provides a roll top backpack with a speaker device, wherein a bag body of the roll top backpack is provided with a speaker device placement hole, the speaker device is arranged in the speaker device placement hole, and the speaker device is sealed with the speaker device placement hole.

Preferably, the speaker device comprises an outer covering film, a fixing plate, a circuit board, a loudspeaker module, a bottom shell and a sealing cover; the waterproof loudspeaker and the circuit board are arranged on the fixing plate, the fixing plate is provided with an outer side and an inner side, the bottom shell is fixed on the inner side of the fixing plate, the outer covering film covers the outer side of the fixing plate, and the sealing cover is covered on the bottom shell and sealed with the outer covering film.

Preferably, the loudspeaker module further comprises a dustproof net and a waterproof loudspeaker, the dustproof net is arranged on the outer side of the fixing plate, and the waterproof loudspeaker is arranged on the inner side of the fixing plate.

Preferably, the circuit board is provided with a wireless transmission module, an audio signal transmission module, a battery module, a control module and a switch module, a waterproof loudspeaker are electrically connected with the audio signal transmission module, and the control module is electrically connected with the battery module and the switch module.

Preferably, the circuit board is provided with an LED lamp and a solar panel electrically connected with the battery module.

Preferably, the circuit board is further provided with a charging module and a discharging module, and the charging module and the discharging module are electrically connected with the battery module.

Preferably, it further comprises a USB interface electrically connected with the battery module.

Preferably, it further comprises a waterproof cap arranged on the USB interface.

REFERENCE NUMERALS

Figure 1:
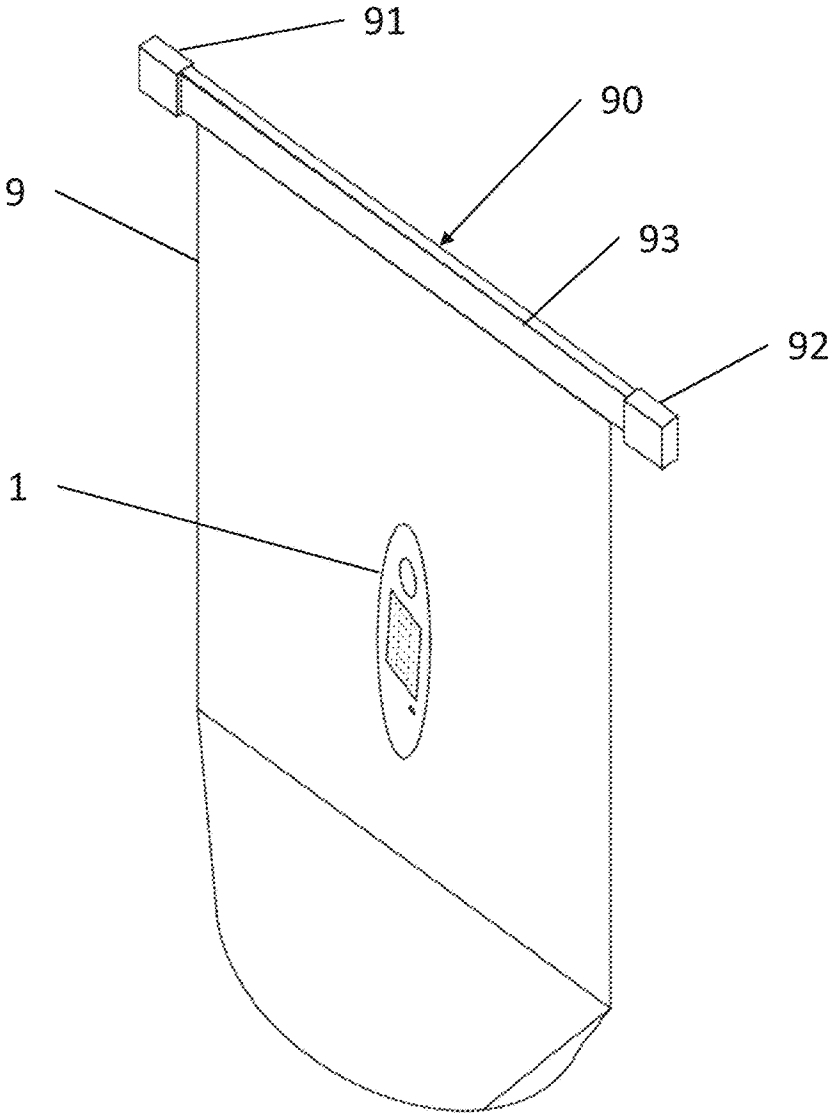
FIG. 1 is a diagram showing uninflated state of the roll top backpack of the utility model.

Speaker device 1
Speaker device placement hole 10
Fused edge 101
Outer covering film 11
Hole 111
Fixing plate 12
Loudspeaker placement area 121
Circuit board placement area 122
Circuit board 13
Wireless transmission module 131
Solar panel 132
Control module 133
Battery module 134
USB interface 135
LED lamp 136
Switch module 137
Audio signal transmission module 138
Loudspeaker module 14
Dustproof net 141
Waterproof loudspeaker 142
Bottom shell 15
Sealing cover 16
Charging module 171
Discharging module 172
Mobile terminal 8
Roll top backpack 9
Opening 90
First connecting part 91
Second connecting part 92
Rolling strip 93

DETAILED DESCRIPTION OF THE UTILITY MODEL

Hereinafter, the technical solution of the present utility model will be clearly and completely described with reference to the accompanying drawings, and it is obvious that the described embodiment is a part of, not the whole, embodiments of the present utility model. Based on the embodiments in the present utility model, all other embodiments obtained by a person skilled in the art without involving any inventive effort are within the scope of protection of the present utility model.

In the description of the present utility model, it is to be noted that the orientation or position relationships indicated by the terms "center", "upper", "lower", "left", "right", "vertical", "horizontal", "inner", "outer", "front", "rear" and the like in the present utility model are based on the orientation or position relationships shown in the drawings. It is intended merely to facilitate a description of the present utility model and to simplify description, and not to indicate or imply that a device or element referred to must have a particular orientation, be constructed and operated in a particular orientation, and thus should not be construed as limiting the present utility model. Furthermore, the terms "first", "second", and "third" are used for descriptive purposes only and are not to be construed as indicating or implying relative importance.

In the description of the present utility model, it should be noted that the terms "mounted", "connected with", and "connected" are to be interpreted broadly, including for example, fixedly connected, as well as detachably connected, or integratedly connected; mechanically connected or electrically connected; connected directly or indirectly by an intermediary, or communicated between two elements, unless expressly specified and limited otherwise. For those skilled in the art, specific meanings of the above terms in the present utility model can be specifically understood.

Figure 2:
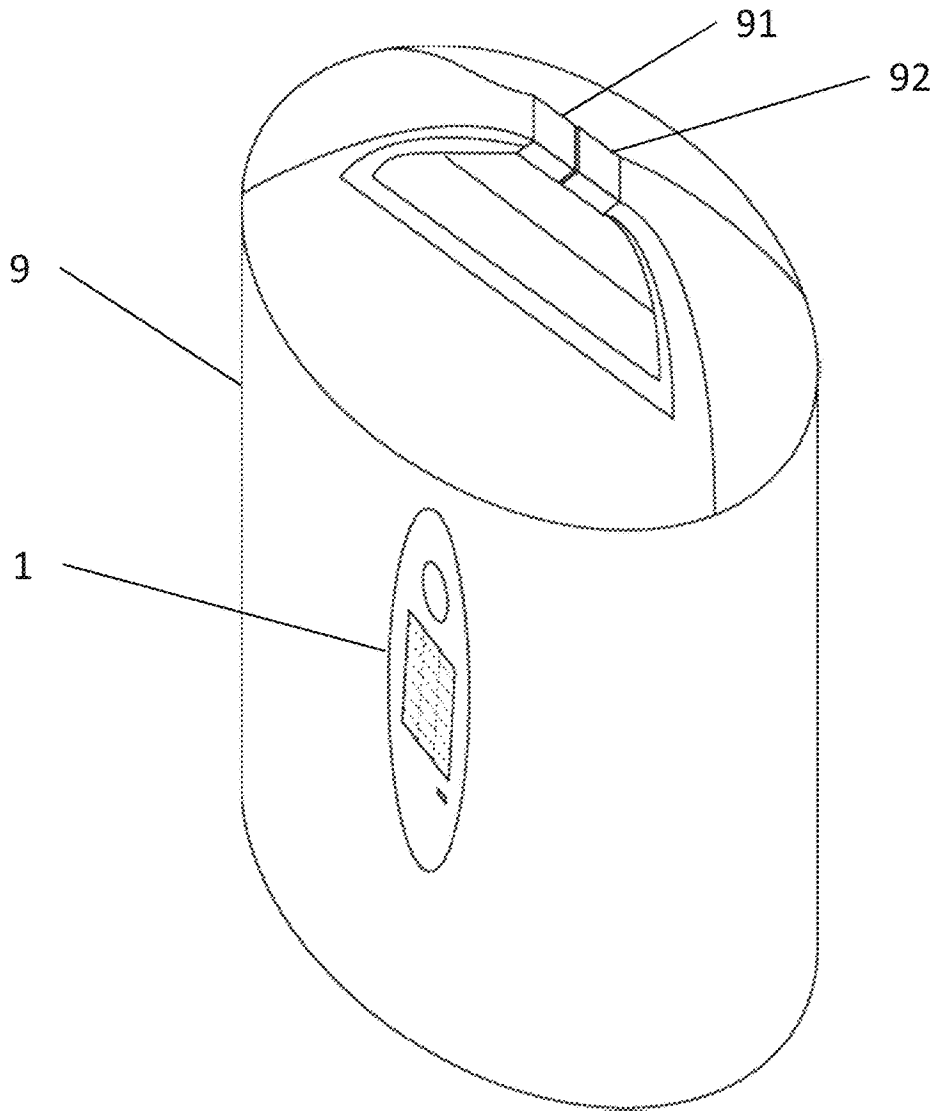
FIG. 2 is a diagram showing inflated state of the roll top backpack of the utility model.

Referring to FIGS. 1 and 2, the utility model includes a speaker device 1 and a roll top backpack 9, wherein the roll top backpack 9 is provided with an opening 90, two sides of the opening 90 are provided with a first connecting part 91 and a second connecting part 92, the first connecting part 91 and the second connecting part 92 can be correspondingly connected, and the first connecting part 91 and the second connecting part 92 can be connected in a buckling mode, a snap-fastening mode, a hook and loop fastening mode or a magnetic attraction mode; a rolling strip 93 is arranged between the first connecting part 91 and the second connecting part 92; after the opening 90 is rolled up along the rolling strip 93 towards the direction of the roll top backpack body, the first connecting part 91 and the second connecting part 92 are clamped, the roll top backpack 9 is in an inflated state to form an air bag shape, and the first connecting part 91 and the second connecting part 92 can form a handle.

Figure 3:
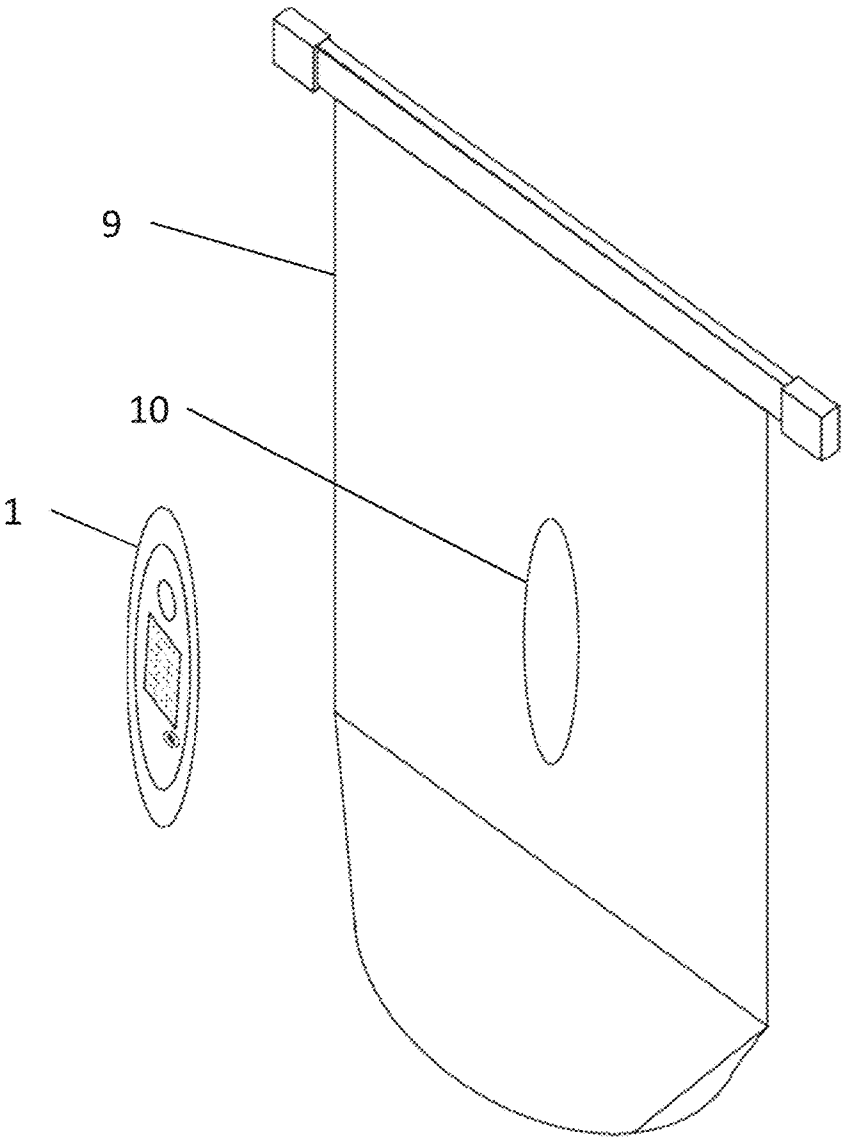
FIG. 3 is a structural schematic diagram showing separation of a speaker device from the roll top backpack of the utility model.

Referring to FIG. 3, a speaker device placement hole 10 is formed in a bag body of a roll top backpack 9, a speaker device 1 is sleeved in the speaker device placement hole 10, the periphery of the speaker device 1 is a fused edge which can be subjected to hot or electric press, and the periphery of the speaker device 1 is sealed with the speaker device placement hole 10; in this embodiment, the mode that the periphery of the speaker device 1 is sealed with the speaker device placement hole 10 is a high-frequency hot or electric press so as to ensure that the periphery of the speaker device 1 is completely and tightly combined with the speaker device placement hole 10 to achieve a waterproof state.

Figure 4:
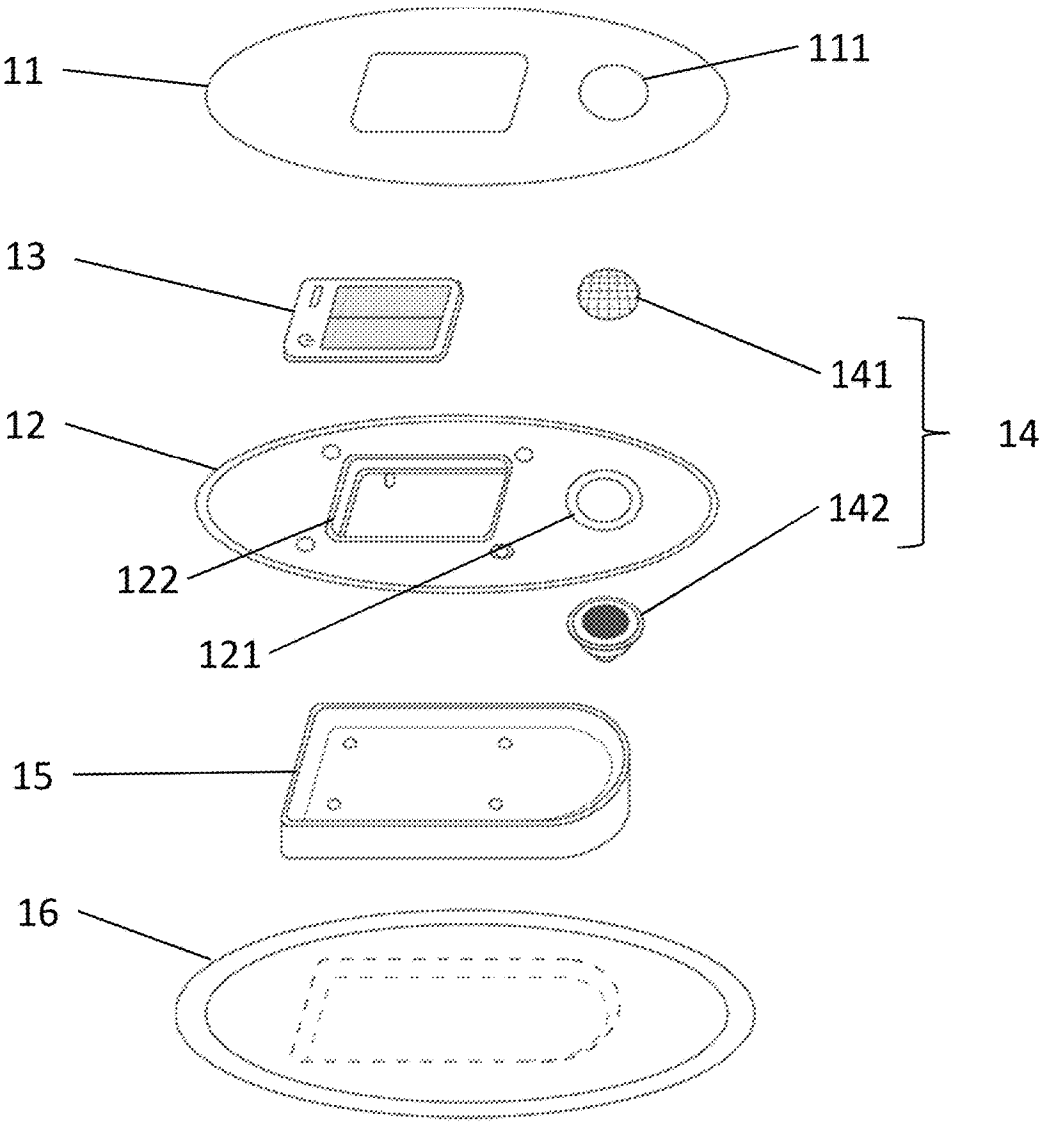
FIG. 4 is a structural exploded schematic diagram of the speaker device.
Figure 5:
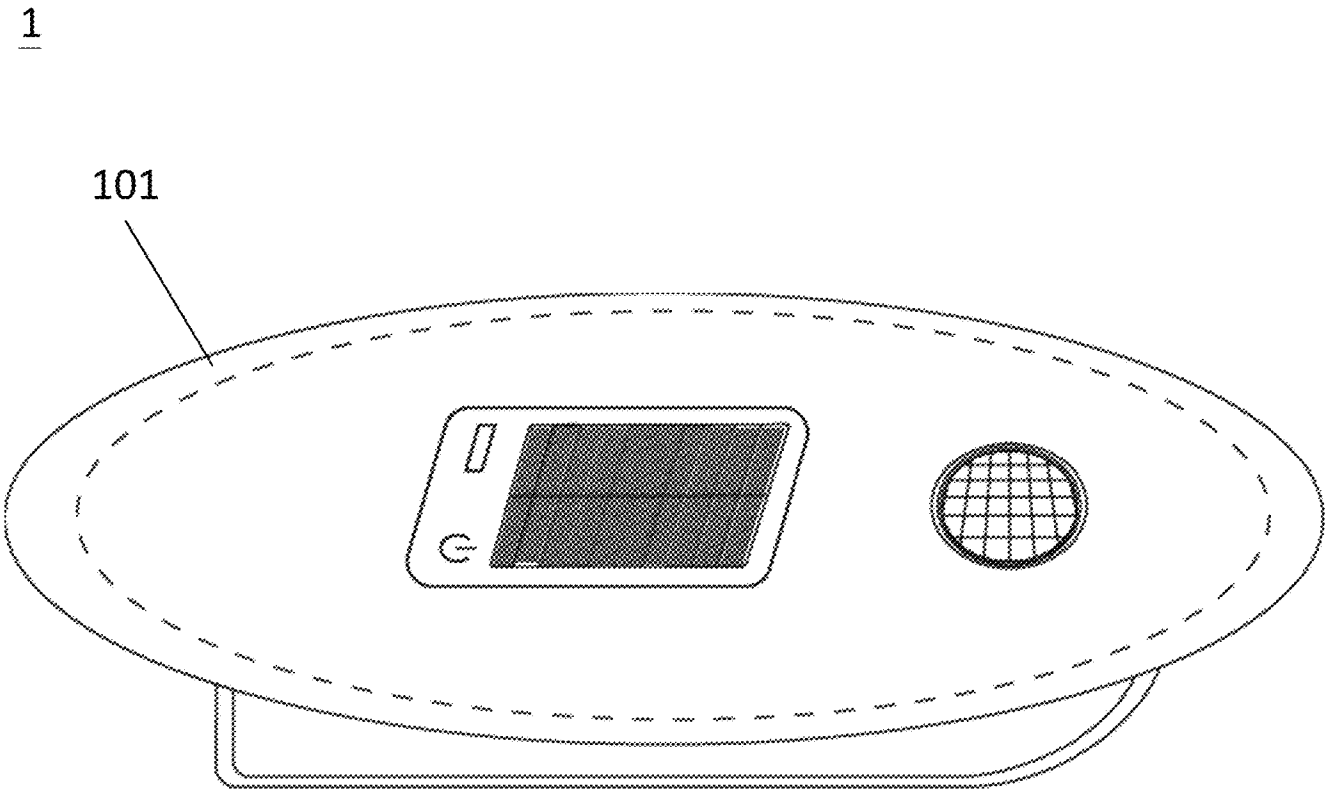
FIG. 5 is a schematic diagram of a peripheral fused edge of the speaker device.
Figure 6:
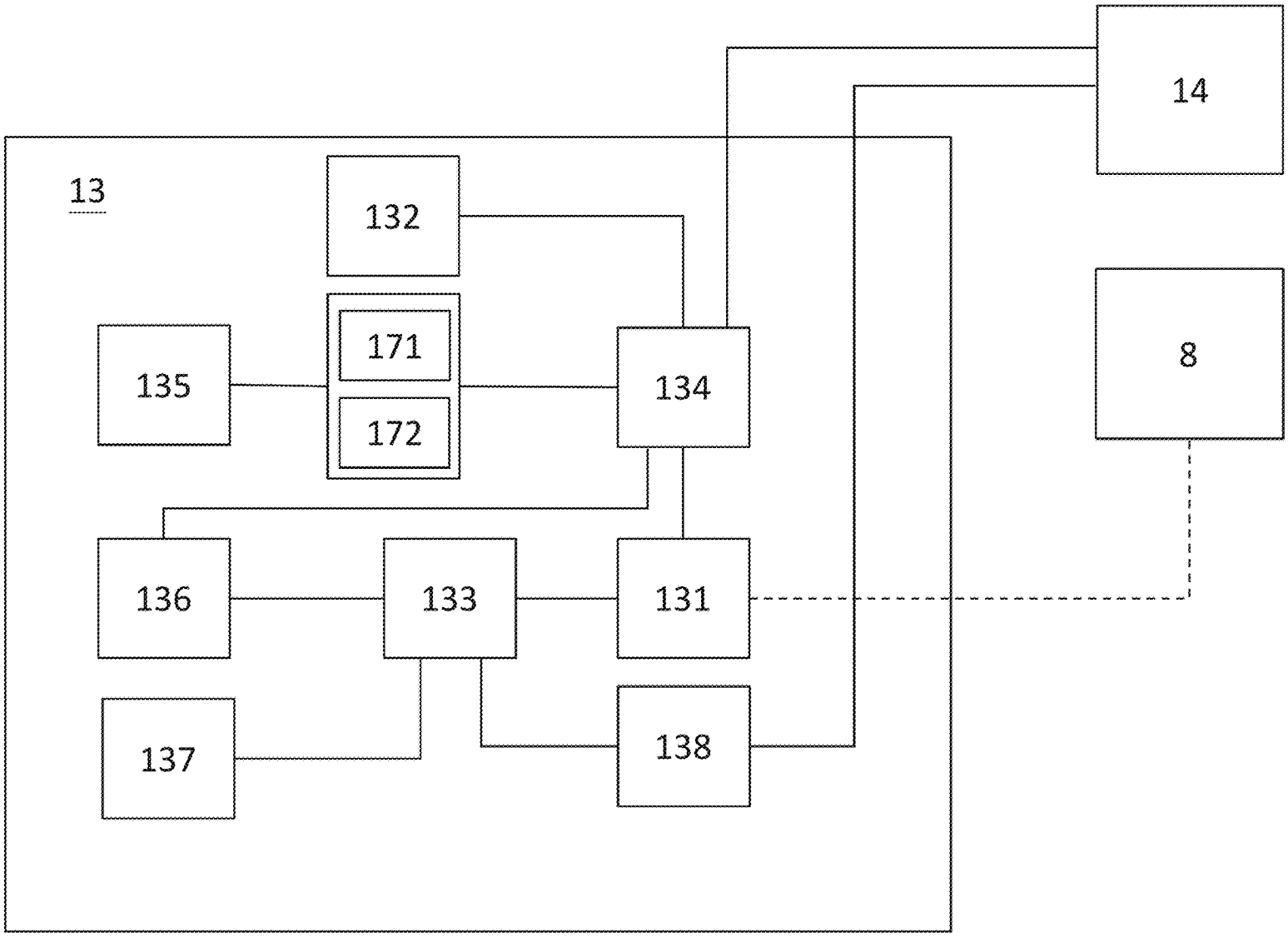
FIG. 6 is a connection schematic diagram of connection relation of circuit board modules.

Referring to FIGS. 4 and 5, the speaker device 1 includes an outer covering film 11, a fixing plate 12, a circuit board 13, a loudspeaker module 14, a bottom shell 15 and a sealing cover 16, wherein the sealing cover 16 is made of a fused material and can be hot or electric-press fused with the outer covering film 11 into a whole, and the loudspeaker module 14 includes a dustproof net 141 and a waterproof loudspeaker 142. The fixing plate 12 has an inner side and an outer side, wherein the inner side refers to a surface located inside the roll top backpack 9, the outer side is a surface located outside the roll top backpack 9, and the fixing plate 12 is further provided with a loudspeaker placement area 121 and a circuit board placement area 122; the waterproof loudspeaker 142 are fixed on the inner side of the loudspeaker placement area 121, and the dustproof net 141 is fixed on the outer side of the loudspeaker placement area 121; the circuit board 13 is provided with the circuit board placement area 122, and the bottom shell 15 is locked on the inner side of the fixing plate 12. In other way, the bottom shell 15 and the fixing plate 12 are fixed by inserting or clamping, such as by inserting in this embodiment; a cavity is formed between the fixing plate 12 and the bottom shell 15 when the fixing plate 12 and the bottom shell 15 are fixed, and the cavity can enable the waterproof loudspeaker 142 to have better sound effect and resonance; the outer covering film 11 covers the outer side of the fixing plate 12, a hole 111 is formed at the position corresponding to the waterproof loudspeaker 142, and the sealing cover 16 is covered on the bottom shell 15 from inside of the roll top backpack 9 and sealed with the outer covering film 11, so that a sealed waterproof space is formed between the sealing cover 16 and the outer covering film 11. It should be noted that after the outer covering film 11 is sealed with the sealing cover 16, the outer covering film 11 is still provided with a fused edge 101 (i.e. the periphery of the speaker device 1) which may be fused with the speaker device placement hole 10 of the roll top backpacks 9, wherein the fused edge 101 overlaps with the periphery of the speaker device placement hole 10, the overlapped part is subjected to hot or electric press to form a fused sealing; and after the speaker device 1 and the speaker device placement hole 10 are sealed, the opening 90 of the roll top backpack 9 is rolled up to form a state in which the outside of the roll top backpack 9 is waterproof while the inside of the roll top backpack 9 is also waterproof. In addition, due to the fact that the hole 111 corresponding to the waterproof loudspeaker 142 is formed in the outer covering film 11, the waterproof and sound transmission effect can be achieved after the sealing cover 16 is sealed with the outer covering film 11.

When the waterproof loudspeaker 142 is installed, sealant can be firstly applied to the edge position of the loudspeaker placement area 121, then the waterproof loudspeaker 142 and the circuit board 13 are placed to the corresponding loudspeaker placement area 121 and the circuit board placement area 122, so that the waterproof loudspeaker 142 and the circuit board 13 are fixed on the fixing plate 12; and then the sealant can be applied once again at the joint of the waterproof loudspeaker 142 and the fixing plate 12, so as to fully ensure the sealing property of the waterproof loudspeaker 142 and the fixing plate 12, enhance the waterproof effect, and prevent water from permeating from the joint of the waterproof loudspeaker 142 and the loudspeaker placement area 121; in order to achieve a better sealing effect, adhesive can be arranged on both surfaces of the outer ring of the dustproof net 141, the dustproof net 141 can be directly adhered to the outer side of the loudspeaker placement area 121 of the fixing plate 12, and the other surface of the dustproof net 141 can be directly adhered to the inner surface of the outer covering film 11, so that the periphery of the hole 111 of the outer covering film 11 is sealed with the dustproof net 141.

In the above-described embodiment, the roll top backpack 9 is made of a waterproof material, such as PVC, PU, 500D-1000D meshed PVC or TPU, or other polyethylene resin material; the outer covering film 11 may be an TPU or PVC film that can be electrically pressed, and the sealing cover 16 may be made of TPU, PVC or resin materials.

In particular, it needs to be mentioned that the speaker device 1 in the present utility model can be used alone, that is, the speaker device 1 in the present utility model has a function of playing audio when it is not sealed with the roll top backpack 9, without being affected by whether it is sealed with the roll top backpack 9 or not.

Referring to FIG. 5, in this embodiment, the circuit board 13 is further provided with a wireless transmission module 131, a solar panel 132, a control module 133, a battery module 134, a switch module 137, an audio signal transmission module 138, a charging module 171 and a discharging module 172; a loudspeaker module 14 is electrically connected with the battery module 134; the outer side of the solar panel 132 fixing plate 12 is convenient to receive sunlight, and the solar panel 132 is electrically connected with the battery module 134; the wireless transmission module 131 can be wirelessly connected with mobile terminals 8, such as mobile phones, tablet computers and the like, in a manner of Bluetooth wireless connection, and a signal is sent to the control module 133 by the mobile terminal 8; the control module 133 is electrically connected with the audio signal transmission module 138, and the audio signal is transmitted to the loudspeaker module 14 by the audio signal transmission module 138; the control module 133 is electrically connected with the switch module 137 which can control play or pause of playing content or music, and the switch module 137 can be a touch control panel or a push control panel; during the daytime, the solar panel 132 collects power and transmits the power to the battery module 134 for storage, and the battery module 134 supplies power to the loudspeaker module 14; further, the circuit board 13 is provided with a USB interface 135, a charging module 171, and a discharging module 172; the charging module 171 and the discharging module 172 are electrically connected with the battery module 132, and the charging module 171 is mainly used for charging the battery module 132, for example, the battery module 134 can be charged by the solar panel 132 or an external charging device, or the discharging module 172 enables the battery module 132 to charge an external mobile terminal; the USB interface 135 is connected with the charging module 171 and the discharging module 172, and configured for connecting with external power supply, such as a charger or an externally chargeable mobile terminal; the battery module is charged by the charger or the externally chargeable mobile terminal 8, or an external device is charged via the USB interface 135. A USB hole (not shown) corresponding to the USB interface 135 is formed in the outer covering film 11, and a waterproof cap (not shown) is arranged in order to ensure the sealing waterproof effect; the waterproof cap and the USB hole in the outer covering film 11 are hot-pressed together to realize the waterproof effect.

Furthermore, the circuit board 13 is also provided with an LED lamp 136 electrically connected with the control module 133 and the battery module 134, the light emitting modes of the LED lamp 136 is controlled by the switch module 137, and the LED lamp 136 can be arranged on the inner side or the outer side of the circuit board 13 or on both sides or on the periphery of the circuit board 13. The light emitting modes of the LED lamp 13 include, but are not limited to, "SOS red light blinking", blinking with music rhythm, RGB free colorful switching, and normally white light.

The basic principle, main features and advantages of the utility model are shown and described in the above. It should be understood by those skilled in the art that the present utility model is not limited by the above-mentioned embodiments, and that only the principles of the present utility model are described in the above-mentioned embodiments and the description. Various changes and modifications may be made to the present utility model without departing from the spirit and scope of the present utility model, and such changes and modifications fall within the scope of the claimed utility model. The scope of protection of the present utility model is defined by the appended claims and their equivalents.

The invention claimed is:

1. A roll top backpack with a speaker device, wherein: a bag body of the roll top backpack is provided with a speaker device placement hole, the speaker device is arranged in the speaker device placement hole, and the speaker device is sealed with the speaker device placement hole, wherein the speaker device comprises an outer covering film, a fixing plate, a circuit board, a loudspeaker module, a bottom shell and a sealing cover; a waterproof loudspeaker and the circuit board are arranged on the fixing plate, the fixing plate is provided with an outer side and an inner side, the bottom shell is fixed on the inner side of the fixing plate, and the outer covering film covers the outer side of the fixing plate; and the sealing cover is covered by the bottom shell and sealed with the outer covering film.

2. The roll top backpack with the speaker device according to claim 1, wherein the loudspeaker module further comprises a dustproof net and a waterproof loudspeaker, wherein the dustproof net is arranged on the outer side of the fixing plate, and the waterproof loudspeaker is arranged on the inner side of the fixing plate.

3. The roll top backpack with the speaker device according to claim 1, wherein the circuit board is provided with a wireless transmission module, an audio signal transmission module, a battery module, a control module and a switch module; the waterproof loudspeaker is electrically connected with the audio signal transmission module, and the control module is electrically connected with the battery module and the switch module.

4. The roll top backpack with the speaker device according to claim 3, wherein the circuit board is provided with an LED lamp and a solar panel, and the LED lamp and the solar panel are electrically connected with the battery module.

5. The roll top backpack with the speaker device according to claim 3, further comprising a charging module and a discharging module, wherein the charging module and the discharging module are electrically connected with the battery module respectively.

6. The roll top backpack with the speaker device according to claim 5, further comprising a USB interface, wherein the USB interface is electrically connected with the battery module.

7. The roll top backpack with the speaker device according to claim 1, wherein the roll top backpack is made of waterproof materials.

* * * * *